US010648732B2

(12) United States Patent
Yang et al.

(10) Patent No.: US 10,648,732 B2
(45) Date of Patent: May 12, 2020

(54) WASHSTAND FURNITURE

(71) Applicant: LG ELECTRONICS INC., Seoul (KR)

(72) Inventors: Inhyung Yang, Seoul (KR); Seongho Kim, Seoul (KR); Ungje Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 128 days.

(21) Appl. No.: 15/915,332

(22) Filed: Mar. 8, 2018

(65) Prior Publication Data

US 2018/0259257 A1 Sep. 13, 2018

(30) Foreign Application Priority Data

Mar. 8, 2017 (KR) ..... 10-2017-0029732

(51) Int. Cl.

| | |
|---|---|
| ***F26B 9/06*** | (2006.01) |
| ***E03C 1/32*** | (2006.01) |
| ***E03C 1/04*** | (2006.01) |
| ***E03C 1/14*** | (2006.01) |
| ***F26B 25/08*** | (2006.01) |
| ***F26B 21/04*** | (2006.01) |

(Continued)

(52) U.S. Cl.

CPC ..... *F26B 9/066* (2013.01); *E03C 1/04* (2013.01); *E03C 1/14* (2013.01); *E03C 1/32* (2013.01); *F26B 3/04* (2013.01); *F26B 21/04* (2013.01); *F26B 25/08* (2013.01); *E03C 1/23* (2013.01); *E03C 2201/40* (2013.01); *E03C 2201/90* (2013.01)

(58) Field of Classification Search

CPC ..... E03C 1/04; E03C 1/14; E03C 1/32; E03C 1/23; E03C 2201/40; F26B 9/066; A47B 81/02; A47B 81/00; A47B 88/00; A47B 88/403; A47B 88/919; A47B 88/969; A47B 88/988; A47B 88/994; D06F 58/10

See application file for complete search history.

(56) References Cited

U.S. PATENT DOCUMENTS

| | | | |
|---|---|---|---|
| 2,175,329 | A | 10/1939 | Watt |
| 2,287,657 | A | 6/1942 | Wiscko1 |
| 4,146,405 | A | 3/1979 | Timmer et al. |

(Continued)

OTHER PUBLICATIONS

U.S. Appl. No. 15/915,193, filed Mar. 8, 2018.

(Continued)

*Primary Examiner* — Janie M Loeppke

(74) *Attorney, Agent, or Firm* — Ked & Associates, LLP

(57) ABSTRACT

Washstand furniture is disclosed. The washstand furniture includes: a wash device including a wash bowl, a water supply assembly for supplying water to the wash bowl, and a drainage assembly for draining the water supplied to the wash bowl; an inner cabinet provided under the wash bowl, the inner cabinet having a space defined therein; an electrically operated module provided in the inner cabinet; an outer cabinet provided outside the inner cabinet for maintaining the rigidity of the washstand furniture; and a storage module provided in a space defined by the wash bowl, the inner cabinet, and the outer cabinet, the storage module having therein a storage space for storing a printed circuit board for controlling the operation of the inner module.

20 Claims, 12 Drawing Sheets

(51) Int. Cl.
*F26B 3/04* (2006.01)
*E03C 1/23* (2006.01)

(56) References Cited

U.S. PATENT DOCUMENTS

| | | | | |
|---|---|---|---|---|
| 5,522,411 | A | 6/1996 | Johnson | |
| 5,702,115 | A | 12/1997 | Pool | |
| 5,727,579 | A | 3/1998 | Chardack | |
| 5,934,298 | A | 8/1999 | Singh | |
| 6,802,578 | B1 | 10/2004 | Lang et al. | |
| 8,245,414 | B2 * | 8/2012 | Watson | F26B 9/066 34/381 |
| 8,283,812 | B2 * | 10/2012 | Azancot | H01F 38/14 307/328 |
| 8,991,067 | B2 | 3/2015 | Zielinski et al. | |
| 9,255,733 | B2 | 2/2016 | Bagwell et al. | |
| 9,887,562 | B2 | 2/2018 | Racenet et al. | |
| 10,317,137 | B2 | 6/2019 | Kim et al. | |
| 2007/0151302 | A1 | 7/2007 | Kendall et al. | |
| 2007/0157378 | A1 * | 7/2007 | Kendall | A47B 67/04 4/630 |
| 2008/0256826 | A1 | 10/2008 | Zarembinski | |
| 2014/0366262 | A1 | 12/2014 | Flynn | |
| 2015/0252515 | A1 | 9/2015 | Henry et al. | |
| 2016/0128528 | A1 | 5/2016 | Stewen et al. | |

OTHER PUBLICATIONS

U.S. Appl. No. 15/915,364, filed Mar. 8, 2018.
U.S. Appl. No. 15/915,267, filed Mar. 8, 2018.
U.S. Appl. No. 15/915,401, filed Mar. 8, 2018.
U.S. Appl. No. 15/915,480, filed Mar. 8, 2018.
U.S. Appl. No. 15/915,421, filed Mar. 8, 2018.
U.S. Office Action dated Oct. 5, 2018 issued in U.S. Appl. No. 15/915,216.
U.S. Notice of Allowance dated Oct. 19, 2018 issued in copending U.S. Appl. No. 15/915,236.
U.S. Office Action dated Aug. 30, 2019 issued in U.S. Appl. No. 15/915,480.
U.S. Office Action dated May 31, 2019 issued in U.S. Appl. No. 15/915,193.
U.S. Office Action dated Oct. 2, 2019 issued in U.S. Appl. No. 15/915,401.

* cited by examiner

WASHSTAND FURNITURE

CROSS-REFERENCE TO RELATED APPLICATIONS

This application claims priority under 35 U.S.C. § 119 to Korean Application No. 10-2017-0029732, filed on Mar. 8, 2017, whose entire disclosure is hereby incorporated by reference.

U.S. application Ser. Nos. 15/915,193; 15/915,364; 15/915,267; 15/915,332; 15/915,401; 15/915,480; 15/915,421; 15/915,216; 15/915,236, all filed on Mar. 8, 2018, are related and are hereby incorporated by reference in their entirety. Further, one of ordinary skill in the art will recognize that features disclosed in these above-noted applications may be combined in any combination with features disclosed herein.

BACKGROUND

1. Field

The present disclosure relates to washstand furniture that utilizes the space under a washstand, and more particularly to washstand furniture having a module received therein.

2. Background

A bathroom has a relatively small storage space for storing bathroom goods. For this reason, furniture may be provided in the space above or under a washstand in order to provide a storage space.

In general, washstand furniture provides space under a washstand that may serve as a storage space. In the washstand furniture, however, the space immediately under a wash bowl may be difficult to use as a storage space, since the wash bowl is curved and since water supply and drainage facilities are provided under the wash bowl and adjacent to the space. In addition, the water supply and drainage facilities are provided so as to be adjacent to the space under the washstand. As a result, the space under the washstand is difficult to use as a storage space due to interference with the water supply and drainage facilities and a possibility of water being introduced into the space from the water supply and/or drainage facilities.

BRIEF DESCRIPTION OF THE DRAWINGS

The embodiments will be described in detail with reference to the following drawings in which like reference numerals refer to like elements, and wherein.

DETAILED DESCRIPTION

Exemplary embodiments of washstand furniture according to the present disclosure will be described with reference to the accompanying drawings.

Figure 1:
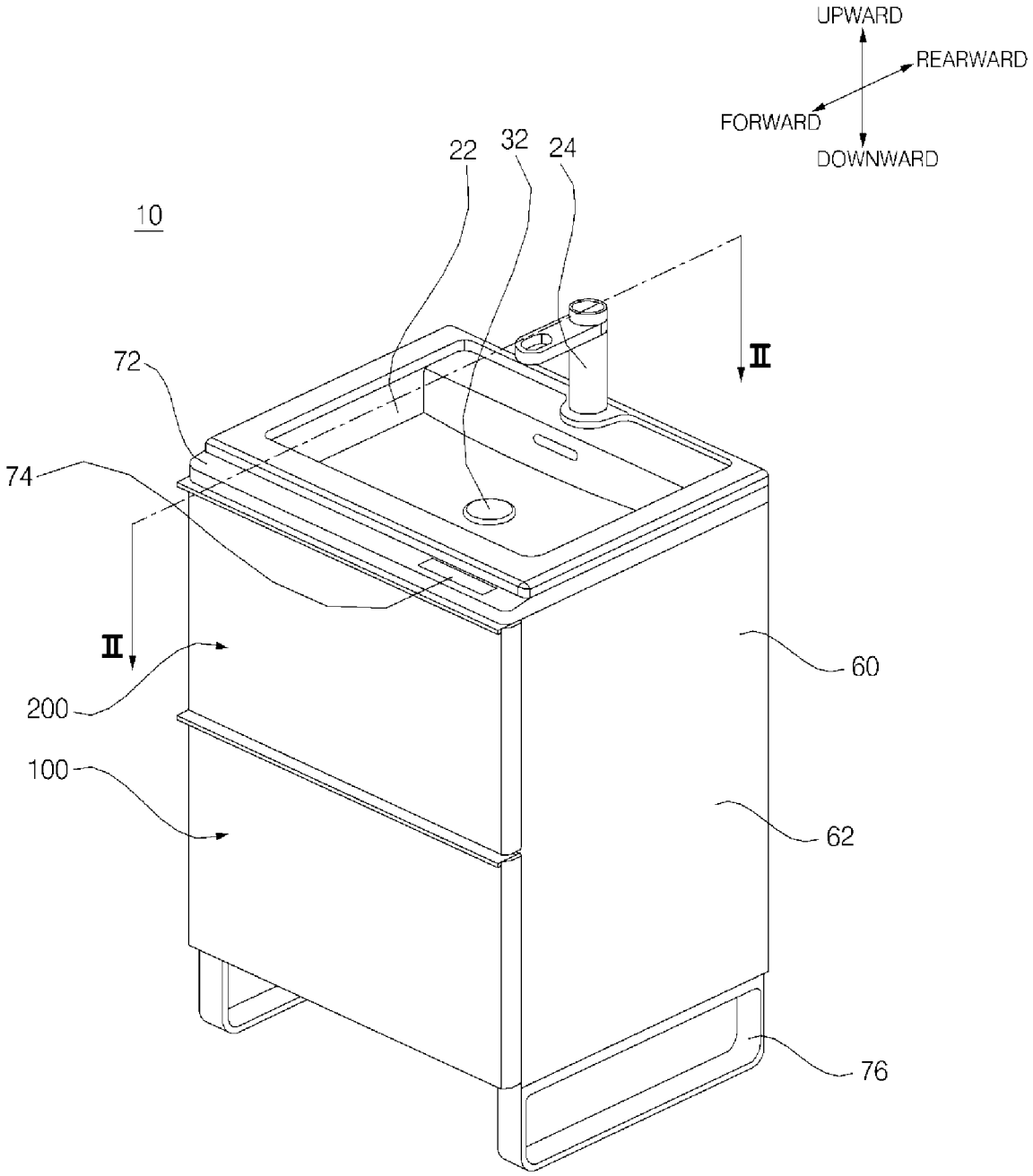
FIG. 1 is a perspective view showing washstand furniture according to an embodiment of the present disclosure.
Figure 2:
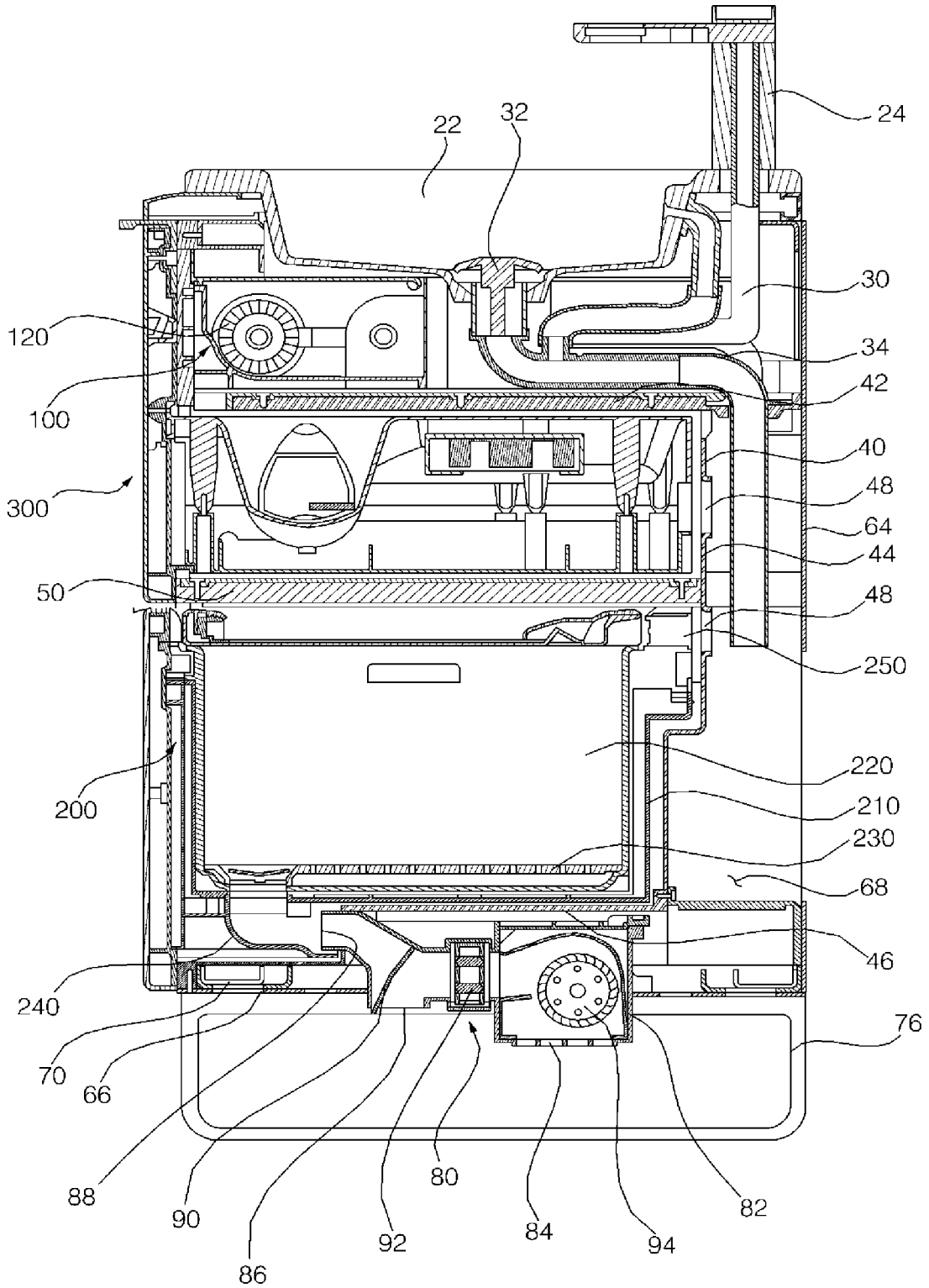
FIG. 2 is a sectional view taken along line II-II' of FIG. 1.
Figure 3:
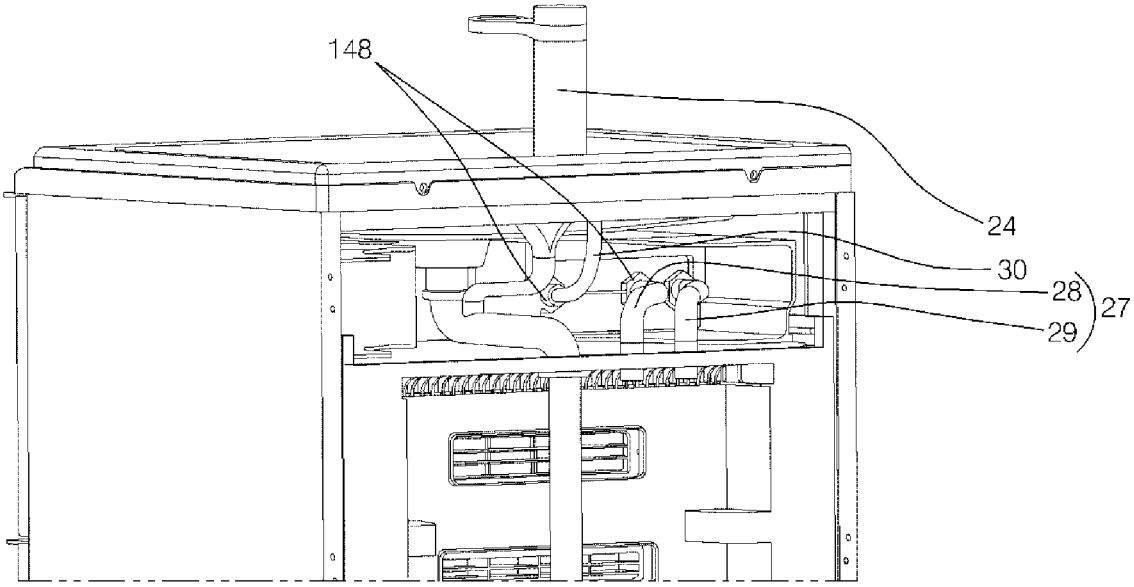
FIG. 3 is a view illustrating the relationships between a water supply assembly, a drainage assembly, and a third module according to an embodiment of the present disclosure.

FIG. 1 is a perspective view showing a washstand furniture (also referred to as a washstand or vanity) 10 according to an embodiment of the present disclosure, and FIG. 2 is a sectional view taken along line II-II' of FIG. 1. FIG. 3 is a view illustrating the relationships between a water supply assembly, a drainage assembly, and a module according to an embodiment of the present disclosure.

The washstand furniture according to this embodiment may include: a wash device or sink that includes a wash bowl, a water supply assembly for supplying water to the wash bowl, and a drainage assembly for draining the water supplied to the wash bowl; an inner cabinet provided under the wash bowl, the inner cabinet having a space defined therein; an electrically operated module provided in the inner cabinet; an outer cabinet provided outside the inner cabinet for maintaining the rigidity of the washstand furniture; and a storage module provided in a space defined by the wash bowl, the inner cabinet, and the outer cabinet, the storage module having therein a storage space for storing a printed circuit board for controlling the operation of the electrically operated module.

Referring to FIG. 1, in the washstand furniture according to this embodiment, the direction in which a module is withdrawn from the cabinet will be referred to as a forward direction, the direction opposite the forward direction (e.g., adjacent to a mounting wall) will be referred to as a rearward direction, the direction in which the wash bowl is provided will be referred to as an upward direction, and the direction in which legs of the washstand furniture are provided (e.g., adjacent to a floor surface) will be referred to as a downward direction, but the same are defined for convenience of description and are not intended to limit the scope of the disclosure.

The wash device is a device that may be provided adjacent to a wall of a restroom, i.e. a washroom, to allow a user to wash his/her face or hands. The wash device may include a wash bowl (also referred to as a sink or basin) 22 that stores water to perform washing, a water supply assembly (also referred to as a tab or faucet) that supplies water to the wash bowl 22, and a drainage assembly (or drain) to remove the water supplied to the wash bowl 22.

An enamel wash bowl or a ceramic wash bowl may be used as the wash bowl 22. In one embodiment, an enamel wash bowl may be used since the enamel wash bowl can be variably formed, and since the lower part of the enamel wash bowl can be coupled to the cabinet. The wash bowl 22 may be provided at the upper part of the washstand furniture 10.

The bottom of the wash bowl 22 may be is curved in order to store water supplied from the water supply assembly or to move the supplied water to the drainage assembly. A space to receive a third module 100 may be defined between the curved bottom of the wash bowl 22 and the inner cabinet 40, which will be described below.

The water supply assembly may include a water supply valve (or faucet) 24 that controls a supply of water to the wash bowl 22, and a water supply hose 26 for supplying water to the water supply valve 24. The water supply valve 24 may be provided at one side of the wash bowl 22 to supply water to the wash bowl 22.

In this embodiment, the washstand furniture 10 may further include a water purification filter 27 that purifies the water that is introduced into the water supply hose 26. The water purification filter 27 may purify the water that is discharged to the wash bowl 22 via the water supply valve 24. The water supply hose 26 may include a first water supply hose 27 for supplying water to the water purification filter and a second water supply hose 30 for supplying the water that has passed through the water purification filter to the water supply valve 24. The first water supply hose 27 may include a hot water supply hose 29 for supplying hot (e.g., heated) water and a cold water supply hose 28 for supplying cold (e.g., unheated temperature) water.

The drainage assembly may include a drainage pipe 34 that discharges the water stored in the wash bowl 22 to the outside and a popup valve 32 that selectively closes to store the water in the wash bowl 22 or opens such that the water stored in the wash bowl 22 moves into the drainage pipe 34. The drainage pipe may extend to the outside of the washstand furniture 10 through the upper surface 42 of the inner case 40.

The cabinet, which defines the external appearance of the washstand furniture 10, may be provided under the wash device. The cabinet maintains the rigidity of the washstand furniture 10 and has a space in which one or more modules is received. In this embodiment, the interior of the cabinet is generally hollow, and the front of the cabinet is generally open, such as to receive one or more modules.

In the embodiment shown in the drawings, the cabinet may include an inner cabinet 40 that receives the module 100 therein, and an outer cabinet 60 provided outside the inner cabinet 40 for increasing the rigidity of the washstand furniture. In this embodiment, the washstand furniture 10 may include the inner cabinet 40 and the outer cabinet 60 such that water is doubly prevented from being introduced into a module accommodated in the inner cabinet 40.

In this embodiment, the inner cabinet 40 may be formed in substantially the shape of a box, and the inner cabinet 40 may have an interior of which is hollow and a front which is open (e.g., to receive a drawer or module). In this embodiment, the outer cabinet 60 may be provided outside the inner cabinet 40. In this embodiment, the outer cabinet 60 may include side-outer cabinets (or side-outer cabinet walls) 62 provided at opposite side surfaces of the inner cabinet 40, a rear-outer cabinet (or rear-outer cabinet wall) 64 provided near a rear surface 44 of the inner cabinet 40, and a base-outer cabinet (or base-outer cabinet wall) 66 provided adjacent to a lower surface 46 of the inner cabinet 40.

One or more modules may be received in the inner cabinet 40. As used herein, the module may be an electrically operated device received in the cabinet. A plurality of modules may be received in the cabinet. For example, the washstand furniture 10 may receive a first module (or drying drawer assembly) 200 and a second module (or heated drawer assembly) 300 in the inner cabinet 40. The first module 200 may be positioned at the lower part of the inner cabinet 40, and the second module 300 may be positioned below the first module 200, such as being located at the upper part of the inner cabinet 40.

The upper surface 42 of the inner cabinet 40 may be positioned so as to be spaced apart from the wash bowl 22 by a predetermined distance. In this embodiment, the washstand furniture 10 may further include a space to accommodate a third module (or controller drawer assembly) 100 provided between the inner cabinet 40 and the wash bowl 22. In this embodiment, the third module 100 may include, for example, a printed circuit board (PCB) 120 to control the operation of the modules provided in the inner cabinet 40. The printed circuit board (PCB) 120 will be described in detail below. In other implementations, the third module 100 may include other components or may perform other functions.

The inner cabinet 40 may include an upper member (or upper opening) 54 (see FIG. 4), which defines an entrance through which the third module 100 is inserted into the inner cabinet 40. The upper member 54 may extend upward from a top of the upper surface 42 of the inner cabinet 40. The upper member 54 may be provided in front of the upper surface 42 of the inner cabinet 40. The upper member 54 spaces the upper surface 42 of the inner cabinet 40 apart from the lower side of the wash bowl 22 by a predetermined distance. The upper member 54 may extend upward from the side surface of the inner cabinet. The upper member 54 is provided under the wash bowl 22.

The inner cabinet 40 may include rail members (or rails) 56 that guide the movement of the third module 100, which is provided above the inner cabinet, in the forward and rearward directions (e.g., to slide the third module 100 in or out of the cabinet). The rail members 56 may protrude from the opposite sides of the upper surface 42 of the inner cabinet 40. The rail members 56 may guide the movement of the third module 100. The rail members 56 may space the third module 100 apart from the upper surface 42 of the inner cabinet 40 by a predetermined distance.

The rail members 56 may be provided at opposite sides of the upper surface 42 of the inner cabinet 40. Each of the rail members 56 may include a vertical projecting part (or vertical rail surface) 57 that spaces the third module 100 apart from the upper surface 42 of the inner cabinet 40 by a predetermined distance and a horizontal projecting part (or horizontal rail surface) 58 that guides the movement of the third module 100 when sliding in the forward and rearward directions.

The inner cabinet 40 may include, at the upper surface 42 thereof, with a protrusion 47 that limits a movement of the third module 100 in the forward direction. The protrusion 47 protrudes upward from the upper surface 42 of the inner cabinet 40. The protrusion 47 may contact a stopper 162 protruding downward from the third module 100, which will be described below, to limit the movement of the third module 100.

The washstand furniture 10 may also include a rail guide 52 that directs a movement of the first module 200 or the second module 300, which is received in the inner cabinet 40. The rail guide 52 may be provided inside the inner cabinet 40. The rail guide 52 may function similarly to the rail members 56.

The inner cabinet 40 may include a communication hole 48 that is positioned to correspond to a suction port or a discharge port of the module 200, 300 received therein with. The communication hole 48, which is connected to a discharge hole of an air conditioner (or dryer) 80 (described below), may be formed in the lower surface 46 of the inner cabinet 40. The air conditioner 80 may be provided between the lower surface of the inner cabinet 40 and the base-outer cabinet 66, and may function to provide an air flow to dry an interior of a module accommodated in the inner cabinet 40.

An external connection channel 68, through which air flows between the modules 100, 200, 300 and to the outside of the washstand furniture 10, may be defined between the rear surface 44 of the inner cabinet 40 and the rear-outer cabinet 64. The lower part of the external connection channel 68 is open so as to be connected to the outside of the washstand furniture 10.

In this embodiment, the washstand furniture 10 may further include a frame 70 provided between the inner cabinet 40 and the outer cabinet 60. The frame 70 may minimize a magnitude of loads from the wash device that are transmitted to the cabinet.

The washstand furniture 10 may include a partition 50 that separates the interior of the inner cabinet 40 into distinct spaces to receive a plurality of modules 200, 300. The partition 50 may partition the interior of the inner cabinet 40 into spaces for receiving the modules. In addition, a wire (not shown) that supplies electric power to the module configured to move (or slide) forward from the interior of the cabinet may be provided at the partition 50.

In this embodiment, the washstand furniture 10 may include an upper cover 72 provided between the wash bowl 22 and the cabinet for primarily blocking water falling from the wash bowl 22. In one embodiment, the washstand furniture 10 may include an input unit (or user interface) 74 that enables a user to input a command for operating the air conditioner 80 or the modules 100, 200, 300. In one implementation, the input unit 74 is provided at one side of the upper cover 72.

As shown in the drawings, the washstand furniture 10 may further include legs 76 for spacing the cabinet apart from the floor of the bathroom by a predetermined distance. The legs 76 may be located below the base-outer cabinet 66.

In one embodiment, the washstand furniture 10 further includes the air conditioner 80 that discharges air through a discharge port connected to the interior of the cabinet. A first module 200 provided in the cabinet may dry utensils stored therein, using the air discharged from the air conditioner 80, and a second module 300 provided in the cabinet may receive and dry separate components of a residual water suction device for suctioning liquid.

In one embodiment, the air conditioner 80 may selectively discharge air to dehumidify the floor of the bathroom or to dry the interiors of the modules 200, 300 provided in the cabinet. The air conditioner 80 may discharge air through a first discharge port 86 facing the floor of the bathroom or through a second discharge port 88 connected to the interior of the cabinet using a fan 94.

In this embodiment, the air conditioner 80 may be provided under the inner cabinet 40. The air conditioner 80 may discharge air to the first module 200, which is provided in the inner cabinet 40, from under the inner cabinet 40. The air conditioner 80 may be provided under the lower surface of the inner cabinet 40. The air conditioner 80 is provided so as to be spaced apart from the floor of the bathroom by a predetermined distance. The air conditioner 80 is spaced apart from the floor of the bathroom by a predetermined distance to discharge air toward the floor of the bathroom.

In one embodiment, the air conditioner 80 may include a housing 82 having, therein, a suction port 84, a first discharge port 86 to dry the floor of the bathroom, and a second discharge port 88 to dry the interiors of one or more modules 200, 300 provided in the cabinet, a fan 94 provided inside the housing 82 to move air from the suction port 84 to the first discharge port 86 or to the second discharge port 88, and a vane 90 that selectively directs the air flowing in the housing 82 through the first discharge port 86 or through the second discharge port 88. The air conditioner 80 may further include a heater 92 that heats and dries the air flowing therein. The air conditioner 80 may further include an air-conditioning filter, such as a mesh, that filters the air that is suctioned into the suction port 84 of the housing 82.

In this embodiment, the first module (or the inner module) 200 may dry utensils that can be used in the bathroom. The first module 200 dries utensils received therein using hot air that is discharged from the air conditioner 80. The first module 200 may include a first module drawer 210 movably provided in the cabinet and having a space defined therein, a basket 220 that detachably provided in the first module drawer 210, and a rack 230 that is provided in the basket 220 to hold the utensils. The interior of the first module drawer 210 may be hollow, and the top of the first module drawer 210 may be open. Consequently, the basket 220 may be inserted or removed through the open top of the drawer.

The first module 200 further includes a first module suction member (or inlet) 240 having therein a suction channel connected to the air conditioner 80 and a first module discharge member (or outlet) 250 having a discharge port for discharging air from the first module 200.

In one embodiment, a residual water suction device, which can be used in the bathroom, may be received in the second module (or the inner module) 300. The second module 300 may remove residual moisture from the residual water suction device. For example, the second module 300 may direct air flow from the air conditioner 80 to the accommodated components of the residual water suction device. The second module 300 may also perform other functions, such as to disinfect the residual water suction device or to charge a rechargeable battery in the residual water suction device.

The residual water suction device, which is received in the second module 300, is a device that removes residual water from the wall of the bathroom by suctioning the same. In this embodiment, the residual water suction device may include a main body having a suction module (e.g., a suction motor) for suctioning a fluid, a liquid-gas separator connected to the main body for separating the suctioned fluid into gas and liquid, and a suction nozzle having a suction port for suctioning the fluid through the operation of the suction module.

In this embodiment, the residual water suction device may be divided into the suction nozzle, the liquid-gas separator, and the main body. The second module 300 may receive, therein, the suction nozzle, the liquid-gas separator, and the main body of the residual water suction device in order to dry the separated suction nozzle, liquid-gas separator, and main body.

Figure 5:
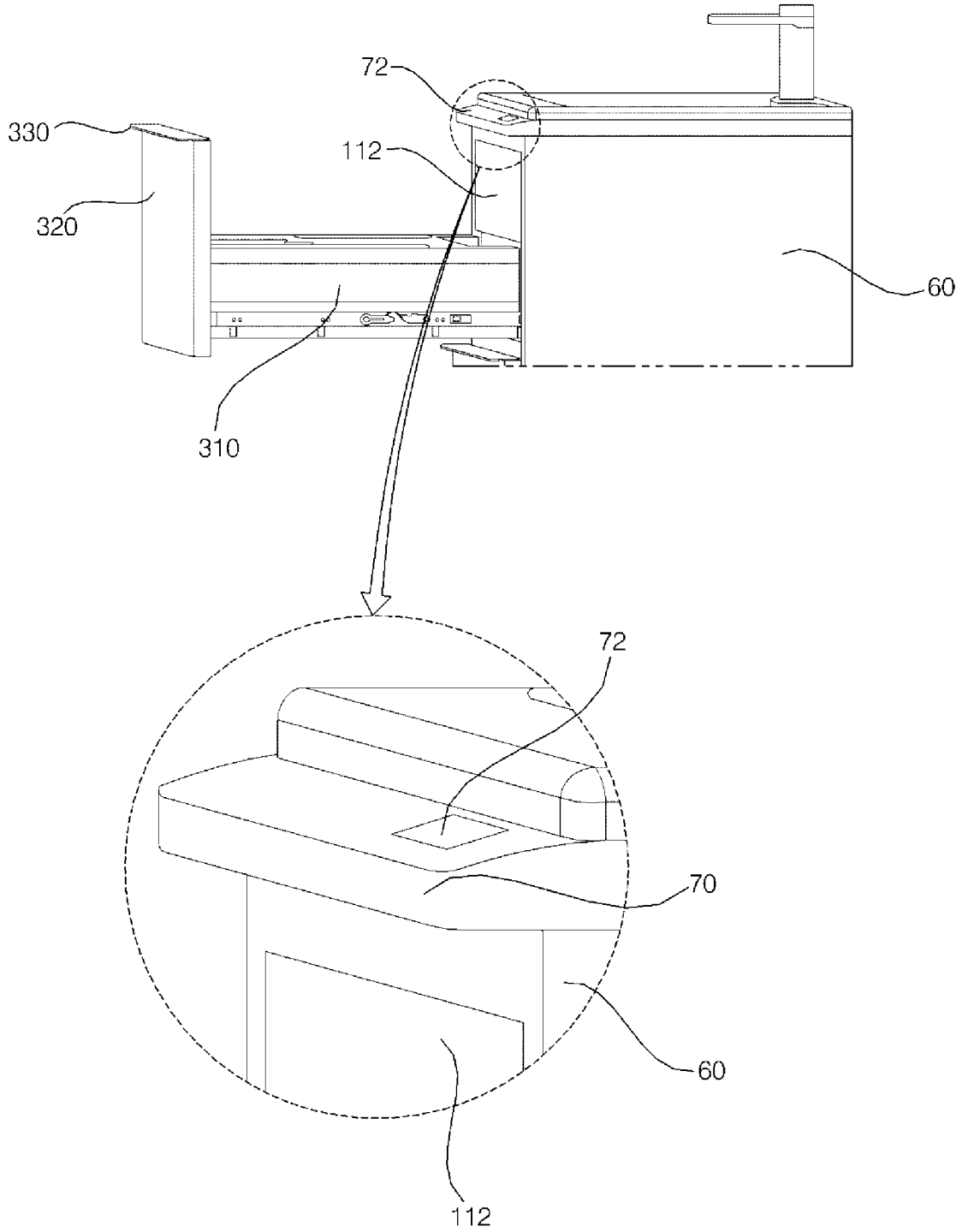
FIG. 5 is a view illustrating the relationship between the third module and an upper cover according to an embodiment of the present disclosure.

The second module 300 may include a plurality of receiving spaces to accommodate the separate components of the residual water suction device. As shown in FIG. 5, the second module 300 may include a second module drawer 310, which is movably provided in the cabinet and which defines a plurality of receiving spaces to accommodate the separate components of the residual water suction device. The second module drawer 310 may also include one or more fans to move air to the receiving spaces.

The second module 300 may include a front cover 320 provided at the front of the second module drawer 310 and a drawer handle 330 protruding from the upper end of the front cover 320. The front cover 320 may cover a portion of the open front of the inner cabinet 40. The front cover 320 of the second module 300 may also cover a front part (or front surface) 112 of the third module 100 provided above the inner cabinet 40, which will be described below.

As previously described, a portion of the upper surface of the second module drawer 310 may be recessed inward to define the receiving spaces. The fans for moving air to the respective receiving spaces may be provided in the second module drawer 310. The second module drawer 310 may also include, at the rear thereof, a suction member having a suction port and through which air flows into the second module drawer 310.

In one example, the second module 300 may further include an ultraviolet lamp (not shown) to sterilize the separate components of the residual water suction device when accommodated in the second module drawer 310. For example, the ultraviolet lamp may be provided inside the front part 112. Alternatively, ultraviolet lamps may be provided in the respective receiving spaces in which the separate components of the residual water suction device are accommodated.

Figure 4:
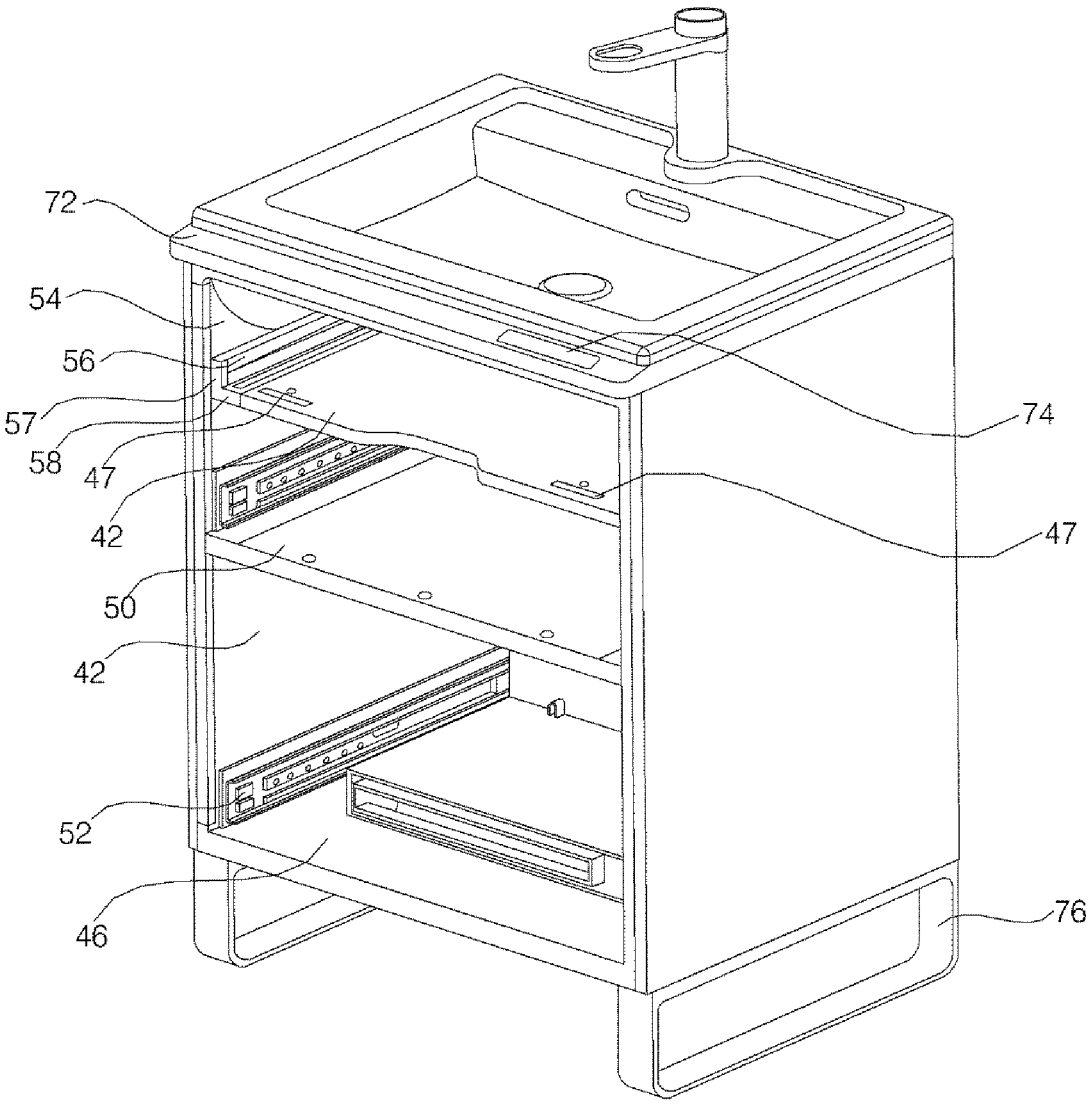
FIG. 4 is a view showing a space defined by an inner cabinet, an outer cabinet, and a wash bowl according to an embodiment of the present disclosure.
Figure 6:
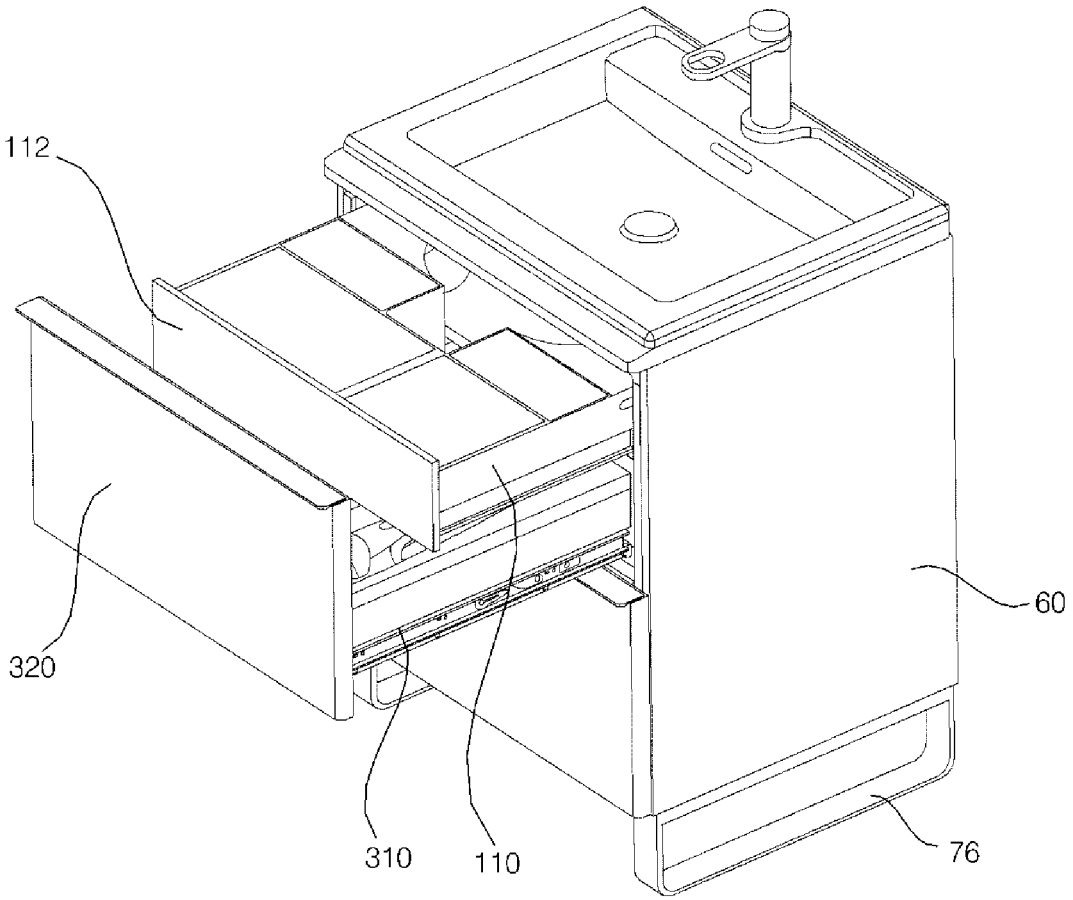
FIG. 6 is a view showing the state in which a second module and a third module according to an embodiment of the present disclosure are withdrawn forward from the washstand furniture.
Figure 7:
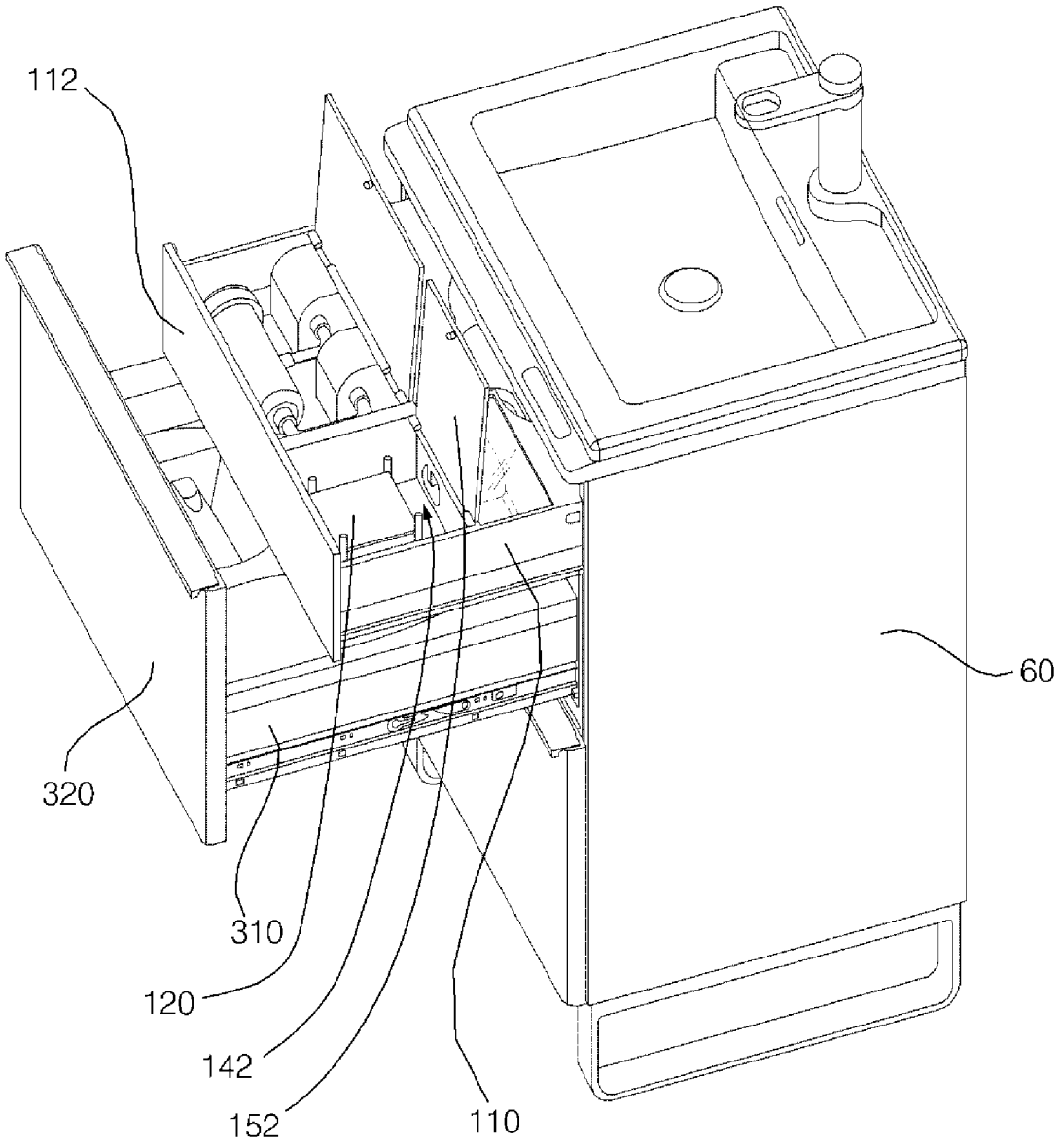
FIG. 7 is a view showing the state in which a portion of a cover provided above a drawer of the third module according to the embodiment of the present disclosure is open.
Figure 8:
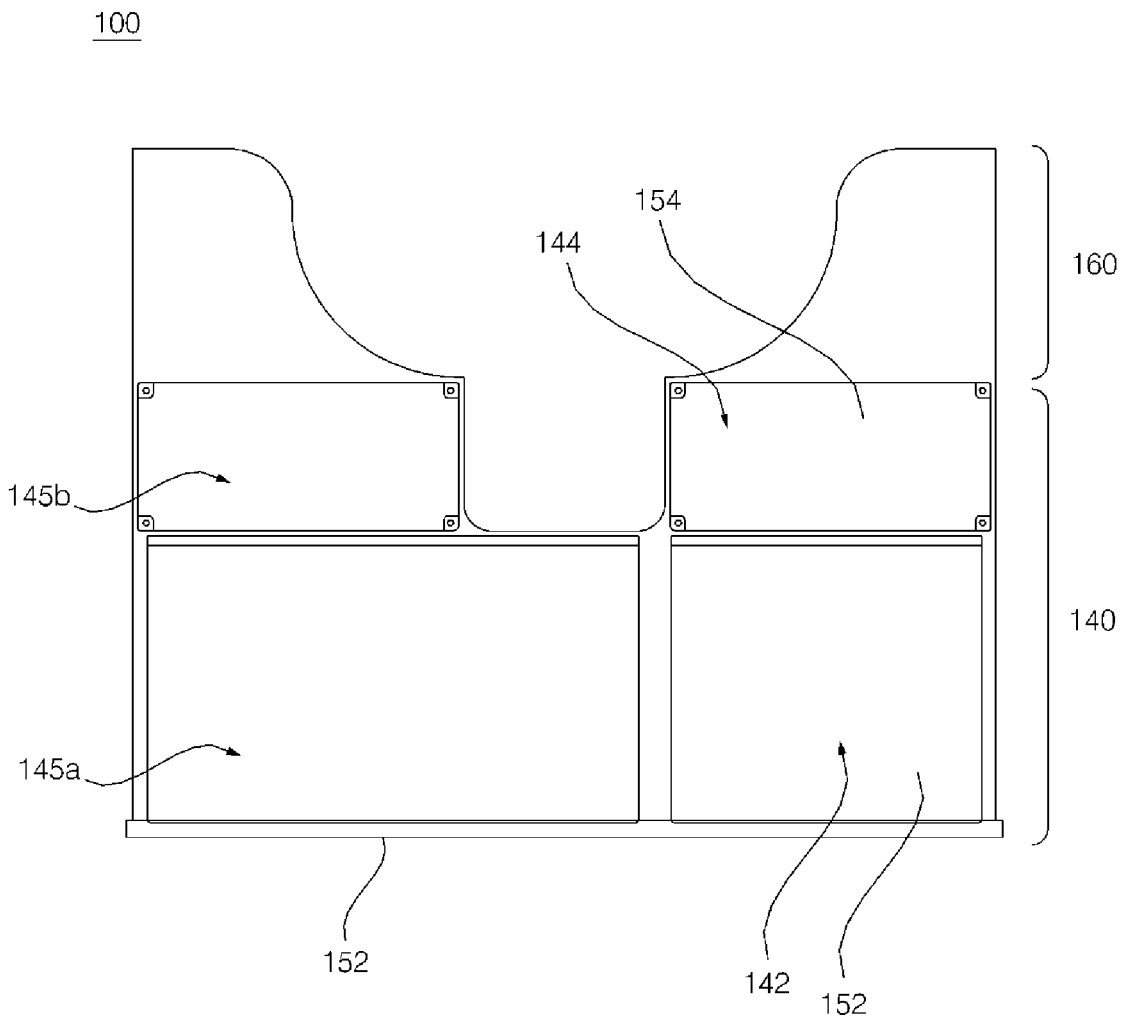
FIG. 8 is a plan view showing the third module according to the embodiment of the present disclosure.
Figure 9:
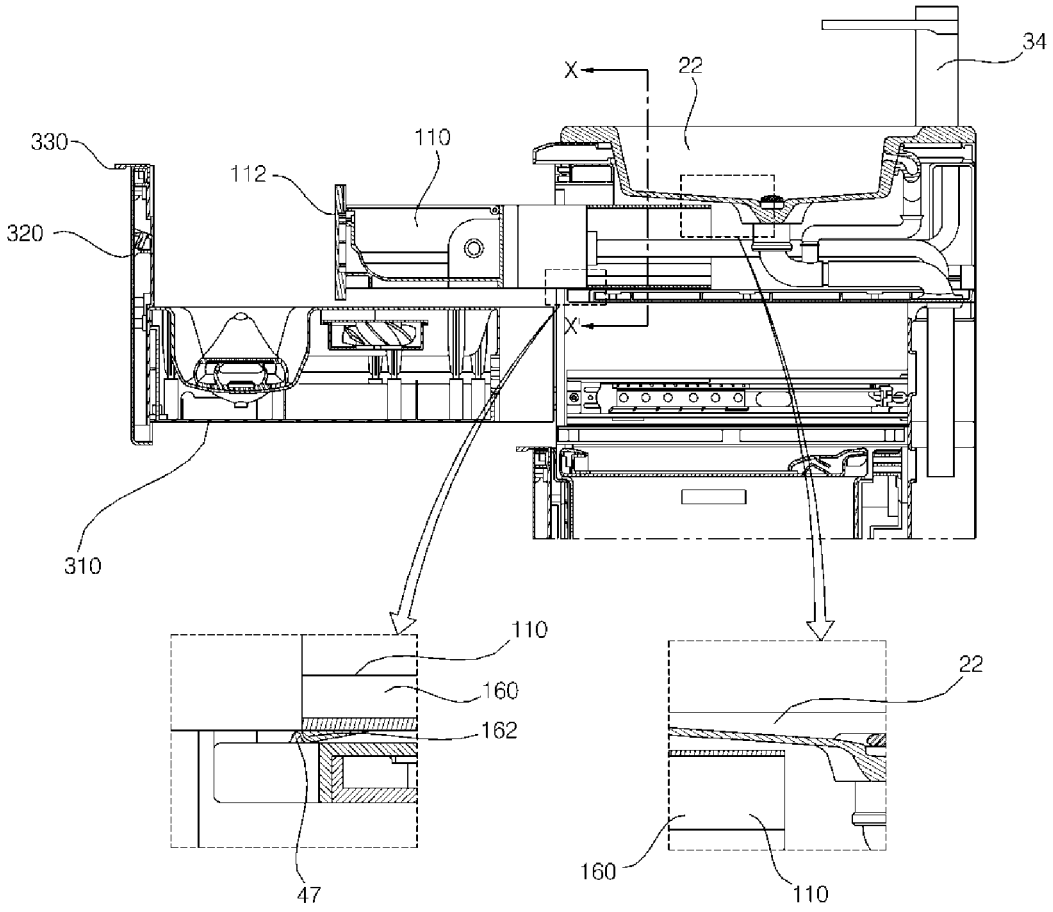
FIG. 9 is a view illustrating an extension and a stopper of the drawer of the third module according to the embodiment of the present disclosure.
Figure 10:
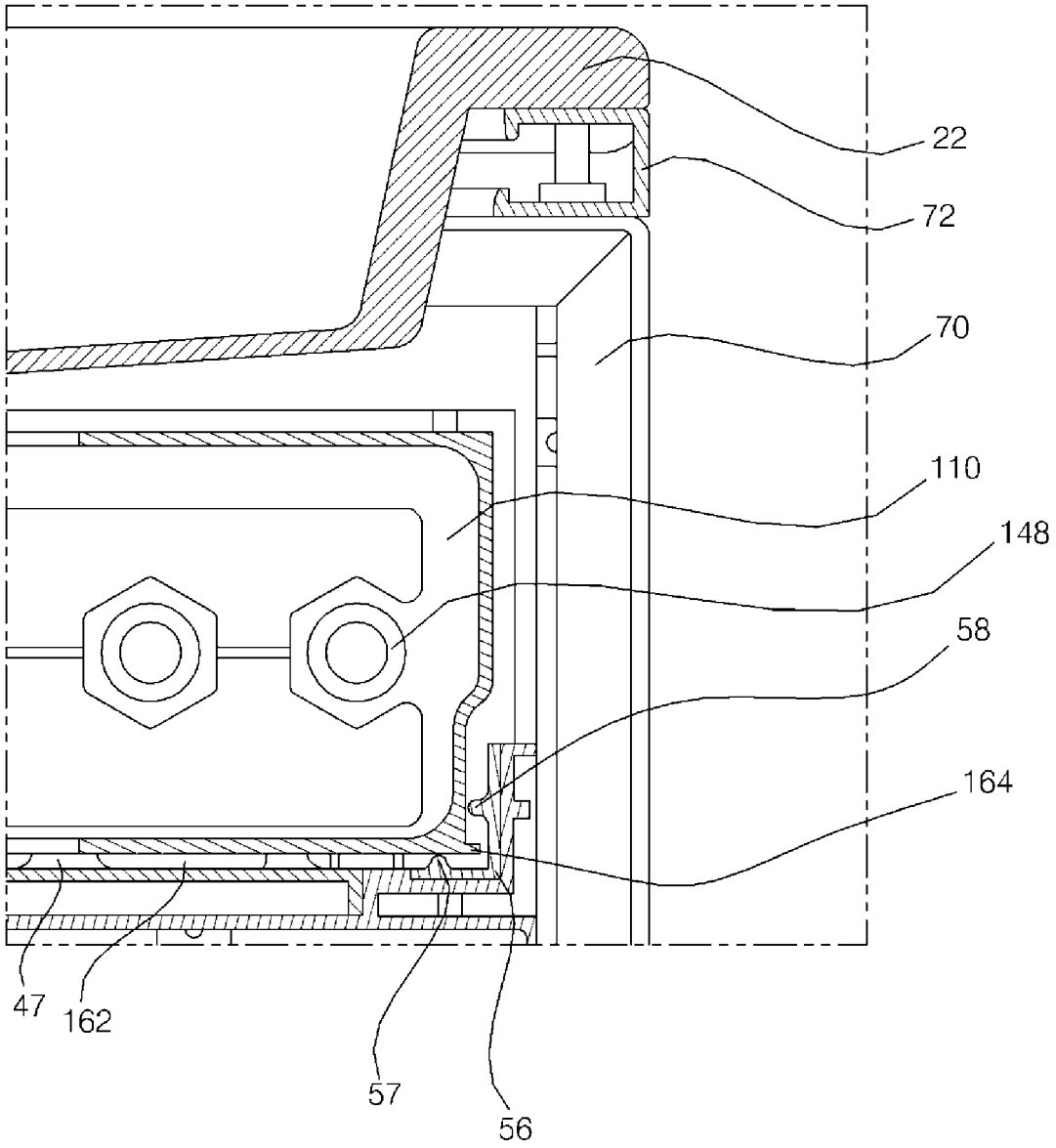
FIG. 10 is a sectional view taken along line X-X' of FIG. 9.
Figure 11:
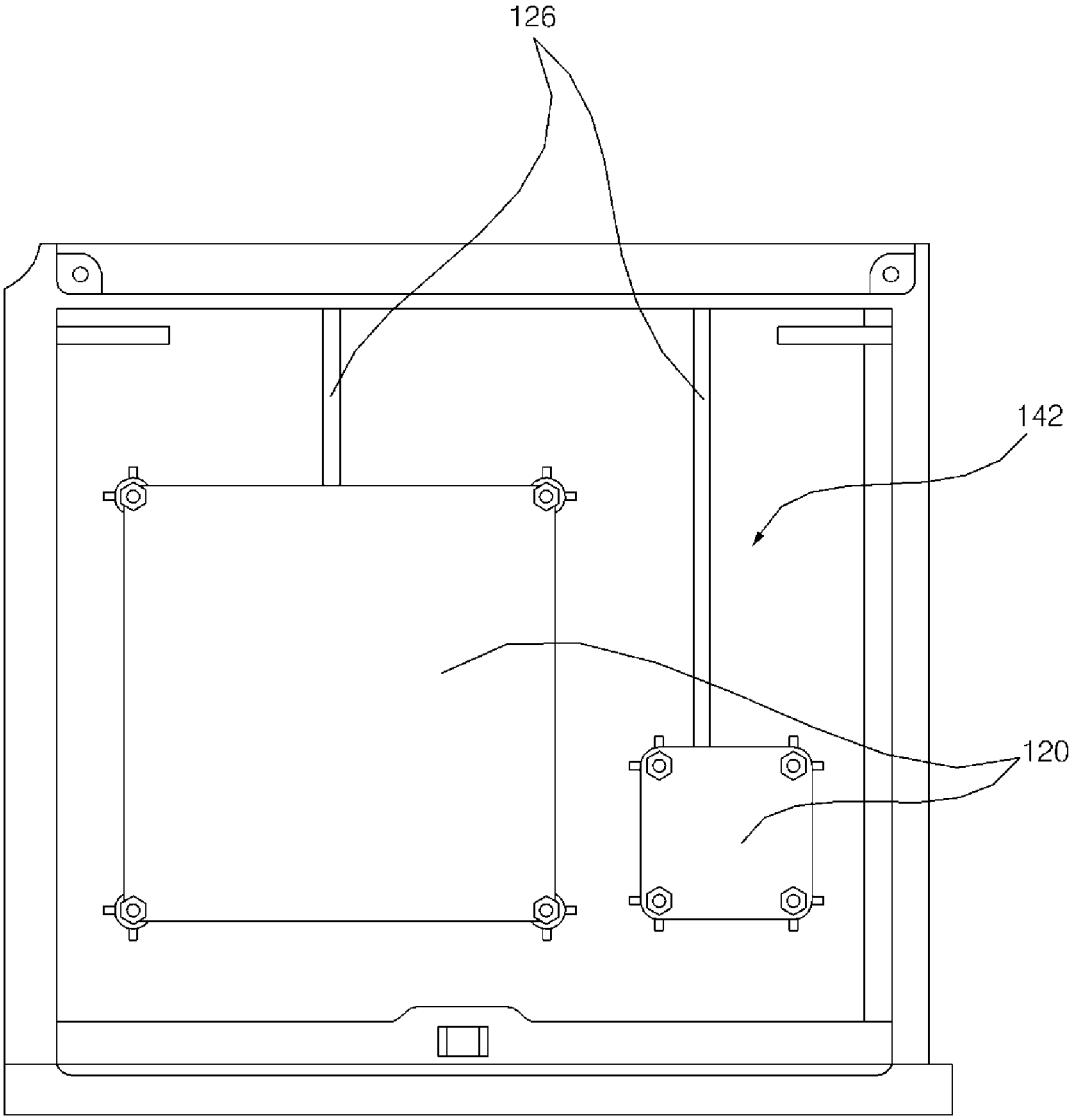
FIG. 11 is a view showing the interior of a first storage space of a drawer according to an embodiment of the present disclosure.
Figure 12:
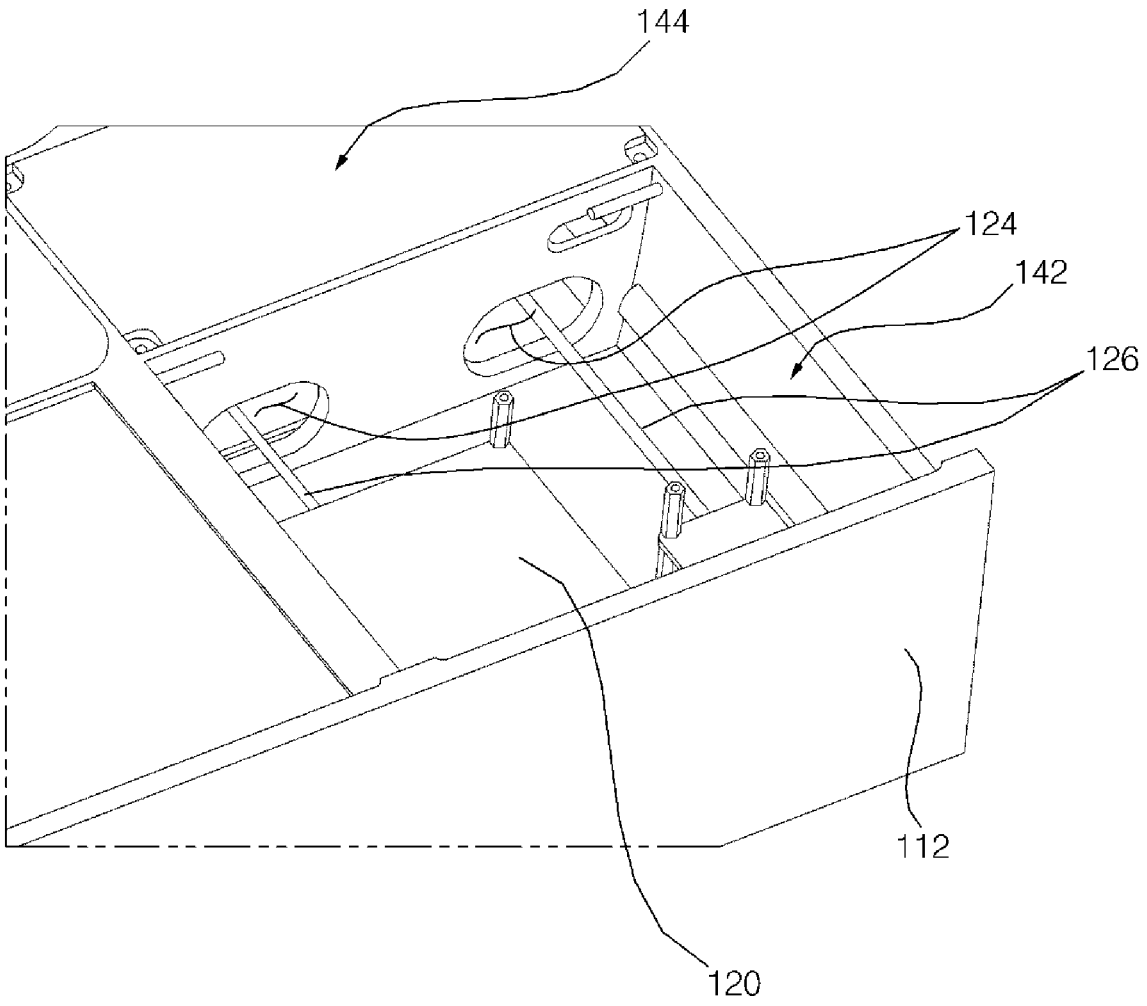
FIG. 12 is a view showing a wire hole formed between the first storage space and a second storage space of the drawer according to the embodiment of the present disclosure.

FIG. 4 is a view showing a space defined by the inner cabinet, the outer cabinet, and the wash bowl, and FIG. 5 is a view illustrating the relationship between the third module and the upper cover according to the embodiment of the present disclosure. FIG. 6 is a view showing the state in which the second module and the third module are withdrawn forward from the washstand furniture, and FIG. 7 is a view showing the state in which a portion of a cover provided above the drawer of the third module is open. FIG. 8 is a plan view showing the third module according to the embodiment of the present disclosure, FIG. 9 is a view illustrating an extension and a stopper of the drawer of the third module, and FIG. 10 is a sectional view taken along line X-X' of FIG. 9. FIG. 11 is a view showing the interior of a first storage space of a drawer, and FIG. 12 is a view showing a wire hole formed between the first storage space and a second storage space of the drawer. Hereinafter, the third module 100 according to this embodiment will be described with reference to FIGS. 4 to 12.

In this embodiment, the third module (or the "storage module") 100 may be provided in the inner cabinet 40. In one example, the third module 100 may control the operation of one or more of electrically operated module. For instance, the third module 100 may control the air conditioner 80, which supplies hot air into the cabinet. In this embodiment, the third module 100 may convert external AC electric power into DC electric power and may supply the DC electric power to the electrically operated module (e.g., to the air conditioner 80) to drive that module.

Referring to FIG. 4, the third module 100 may be provided in a space defined by the wash bowl 22, the inner cabinet 40, and the outer cabinet. The third module 100 may be provided between the inner cabinet 40 and the wash bowl 22. The third module 100 may be provided in a space defined by the upper side of the inner cabinet 40 and the lower side of the wash bowl 22. Portions of the outer cabinet may be positioned at the side and the rear of the third module 100. For example, the third module 100 may located in a space defined by the upper surface 42 of the inner cabinet 40, the side-outer cabinet 62, the rear-outer cabinet 64, and the wash bowl 22.

The third module 100 may be provided at a position at which the third module 100 does not contact or is interfered by the drainage pipe 34 of the drainage assembly. The third module 100 may be provided in a space defined by the curved bottom of the wash bowl 22 and the upper surface 42 of the inner cabinet 40.

The third module 100 may be provided under the upper cover 72. Referring to FIG. 5, the upper cover 72 may protrude further forward than to extend over the third module 100. The upper cover 72 may help prevent water falling from the wash bowl 22 from being introduced into the space where the third module 100 is received.

The third module 100 may be provided inside the front cover 320 of the second module 300. As shown in FIG. 5, the front cover 320 of the second module 300 may cover the front part 112 of the third module 100. In this implementation, the third module 100 may be withdrawn when which the second module 300 is also withdrawn forward.

The third module 100 may include a drawer 110, which is movably provided between the inner cabinet 40 and the wash bowl 22 and which includes therein a plurality of storage spaces, and a front part (or front wall) 112 that covers the front surface of the drawer 110. The front part 112 may be provided in front of the drawer 110 (e.g., between the drawer 110 and the front cover 300).

A plurality of storage spaces may be provided in the drawer 110. In this embodiment, the drawer 110 may have, therein, a first storage space to receive the printed circuit board 120 that controls the operation of the first module 200 or the second module 300, and a second storage space to receive a converter 130 to convert AC electric power to DC electric power. The first storage space may be provided in a front of the drawer 100, and the second storage space may be provided at a rear of the first storage space.

A plurality of wire holes 124, through which wires 126 extend, may be formed between the first storage space and the second storage space. The wires 126 may include, for example, a wire that connects the converter and the printed circuit board 120 and another wire that connects the printed circuit board 120 and one of the modules installed in the washstand furniture 10, and these wires may extend through the wire holes 124.

The printed circuit board 120 in the first storage space may control, for example, an operation of one or more of the first module 200, the second module 300, or the air conditioner 80 in response to an input signal from the input unit 74. In another example, the first storage space may receive a plurality of printed circuit boards 120, such as three printed circuit boards 120 to control, respectively, the operations of the first module 200, the second module 300, and the air conditioner 80

The drawer 110 may include a first cover 152 that opens and closes the open upper side of the first storage space and a second cover 154 to open and close the open upper side of the second storage space. The first cover 152 may be hingedly connected to the upper side of the drawer 110. The second cover 154 is fastened to the upper side of the drawer 110 using fasteners, such as bolts, screws or an adhesive.

The drawer 110 may include a reception unit 150 (or a receiving recess) having therein a plurality of storage spaces and an extension extending rearward from the reception unit. The extension 160 may extend rearward from the reception unit without interfering with the wash bowl 22 or with the drainage assembly. The extension 160 may engage another section of the washstand furniture to help prevent the drawer 110 from falling over forward when the drawer 110 is withdrawn.

The third module 100 may include a stopper 162 that protrudes downward from the drawer 110 and limits a withdrawal distance of the drawer 110. The stopper 162 may be formed at the rear of a lower side of the drawer 100. For example, the stopper 162 may be formed at the lower side of the extension 160. The stopper 162 may contact the protrusion 47, which protrudes upward from the upper surface of the inner cabinet 40, whereby the forward withdrawal thereof is limited.

Rail protrusions 164 may be formed at lower sides of opposite side surfaces of the drawer 110 so as to protrude toward the rail members 56 of the inner cabinet 40. The rail protrusions 164 may protrude outward from the drawer 110 so as to be substantially parallel to the horizontal projecting parts 58 of the rail members 56.

The rail protrusions 164 may be positioned so as to be spaced apart from the horizontal projecting parts 58 of the rail members 56 by a predetermined distance. The distance between each of the rail protrusions 164 and a corresponding one of the horizontal projecting parts 58 may correspond to a length that the stopper 162 protrudes from the lower side of the drawer 110.

In the embodiment shown in the drawings, the third module 100 may further include one or more water purification filters provided in the storage spaces defined in the drawer 110 and that purify water provided through the water supply valve 24. In addition, the third module 100 may further include temperature controllers (not shown) provided in the storage spaces defined in the drawer 110 that modifies or otherwise control the temperature of water that is supplied to the water supply valve 24. For example, the third module 100 may include sensor to determine an temperature of supplied water and at least one of a heater or a chiller to change a temperature of the supplied water when the measured temperature differs from a desired level (e.g., a temperature defined based on a received user input through the input unit 74) by at least a threshold amount.

In this embodiment, the drawer 110 of the third module 100 may further have therein additional storage spaces 145*a* and 145*b*, in addition to the first storage space 142 and the second storage space 144. The water purification filters and/or the temperature controllers may be provided in the additional storage spaces 145*a* and 145*b*.

As is apparent from the above description, the washstand furniture according to the present disclosure may have the following aspects. First, the module to receive a printed circuit board may be provided in the space defined between the cabinet and the wash bowl, in addition to the space defined in the cabinet, whereby it is possible to maximize the efficiency of spatial utilization. Second, water may be prevented from being introduced into the storage module using the upper cover and the front cover of the inner module, whereby it is possible to stably dispose the printed circuit board. Third, the storage module may include an extension and a stopper, whereby it is possible to stably dispose the storage module without withdrawing the storage module outward.

An aspect of the present disclosure provides a washstand furniture having highly efficient spatial utilization. Another aspect of the present disclosure to provide washstand furniture configured such that electric devices are safely provided therein without coming into contact with water. The aspects of the present disclosure are not limited to the above-mentioned aspects, and other aspects that have not been mentioned above will become evident to those skilled in the art from the following description.

In accordance with the present disclosure, the above and other aspects can be accomplished by washstand furniture that includes: a wash device including a wash bowl, a water supply assembly for supplying water to the wash bowl, and a drainage assembly for draining the water supplied to the wash bowl; an inner cabinet provided under the wash bowl, the inner cabinet having a space defined therein; an electrically operated inner module provided in the inner cabinet; an outer cabinet provided outside the inner cabinet for maintaining the rigidity of the washstand furniture; and a storage module provided in a space defined by the wash bowl, the inner cabinet, and the outer cabinet, the storage module having therein a storage space for storing a printed circuit board for controlling the operation of the inner module, whereby the space defined between the wash bowl and the inner cabinet is utilized.

The washstand furniture may further include an upper cover provided under the wash bowl, the upper cover protruding forward from the upper side of the storage module. The inner module may have a front cover for covering the front surface of the storage module. Consequently, the storage module is doubly covered.

The storage module may include: a drawer movably provided between the inner cabinet and the wash bowl, the drawer having therein a plurality of storage spaces; and a front part provided in front of the drawer for covering the front surface of the drawer. The drawer may include a reception unit having therein a plurality of storage spaces and an extension extending rearward from the reception unit. The inner cabinet may be provided at the upper surface thereof with a protrusion, the protrusion protruding upward, and the drawer may include a stopper configured to contact the protrusion in order to limit the forward withdrawal of the storage module. Consequently, it is possible to prevent the drawer of the storage module from being withdrawn too far forward.

Those skilled in the art will appreciate that the present disclosure may be carried out in specific ways other than those set forth herein without departing from the spirit and essential characteristics of the present disclosure. The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. Washstand furniture comprising:

a wash bowl;

a faucet that supplies water to the wash bowl;

a drain that removes the water supplied to the wash bowl;

an inner cabinet provided under the wash bowl, the inner cabinet having a first space defined therein;

an electrically operated inner module provided in the first space of the inner cabinet;

an outer cabinet provided outside the inner cabinet; and a storage module provided in a second space defined by the wash bowl, the inner cabinet, and the outer cabinet, the storage module having therein a storage space to receive a printed circuit board that controls an operation of the inner module, wherein the inner module includes a front cover over a front surface of the storage module.

2. The washstand furniture according to claim 1, wherein the second space is defined between a lower surface of the wash bowl and an upper surface of the inner cabinet, and the outer cabinet covers side surfaces and a rear surface of the storage module.

3. The washstand furniture according to claim 1, wherein the inner cabinet includes an upper opening having an entrance through which the storage module is inserted.

4. The washstand furniture according to claim 1, further comprising an upper cover provided under the wash bowl, the upper cover protruding forward from an upper surface of the storage module.

5. The washstand furniture according to claim 1, wherein the storage module includes:

a drawer that is movably provided between the inner cabinet and the wash bowl, the drawer having therein a plurality of storage spaces; and a front wall provided in front of the drawer and that covers a front surface of the drawer.

6. The washstand furniture according to claim 5, wherein the drawer further includes a receiving space having therein a plurality of storage spaces and an extension extending rearward from the receiving space.

7. The washstand furniture according to claim 6, wherein the extension extends rearward from the receiving space without interfering with the wash bowl or the drain.

8. The washstand furniture according to claim 5, wherein the inner cabinet includes an upper surface having a protrusion that extends upward, and the drawer includes a downward protrusion configured to selectively contact the protrusion such that a forward withdrawal of the storage module is limited.

9. The washstand furniture according to claim 5, wherein the drawer has therein a first storage space to receive the printed circuit board, and a second storage space to receive a converter that converts alternating current (AC) electric power to direct current (DC) electric power.

10. The washstand furniture according to claim 9, wherein the second storage space is provided in front of the first storage space, and a cover is hingedly connected to an upper side of the first storage space.

11. The washstand furniture according to claim 9, wherein a wire hole is provided between the first storage space and the second storage space, and a wire that connects the printed circuit board and the converter extends through the wire hole.

12. The washstand furniture according to claim 5, wherein the inner cabinet includes rails that guide movement of the storage module above the inner cabinet, in forward and rearward directions, and each of the rails includes a vertical projection that spaces the storage module from an upper surface of the inner cabinet by a predetermined distance and a horizontal projection that guides the movement of the storage module in the forward and rearward directions.

13. The washstand furniture according to claim 12, wherein the storage module further includes, at lower sides of opposite side surfaces of the drawer, rail protrusions formed so as to protrude toward the rails of the inner cabinet, and the rail protrusions extend outward from the drawer so as to be parallel to the horizontal projections of the rails.

14. The washstand furniture according to claim 13, wherein the inner cabinet includes, at the upper surface thereof, a protrusion that extends upward, the drawer includes a downward extension configured to contact the protrusion and to limit forward withdrawal of the storage module, and a distance between each of the rail protrusions and a corresponding one of the horizontal projections corresponds to a protruding length of the downward extension from a lower side of the drawer.

15. The washstand furniture according to claim 1, further comprising a user interface, wherein the printed circuit board controls the operation of the inner module based on an input received via the user interface.

16. The washstand furniture according to claim 1, wherein the inner module is configured to receive and dry components of a residual water suction device using one or more fans included in the inner module.

17. The washstand furniture according to claim 10, wherein the inner cabinet is further configured to receive another module to accommodate items, and wherein washstand furniture further includes:

a dryer provided outside the inner cabinet, the dryer including a fan to generate an air flow and a heater to heat the air flow, and one or more communication holes that direct the heated air flow from the dryer and to the other module.

18. The washstand furniture according to claim 17, wherein the dryer further includes a vane to selectively direct the heated air flow to the other module via the one or more communication holes or to a floor surface under the washstand furniture.

19. The washstand furniture according to claim 17, wherein the printed circuit board is further configured to control the dryer.

20. A washstand comprising:

a first cabinet having a first space defined therein and provided under sink that receives water from a faucet and has a drain to remove water;

an electrically operated device provided in the first space of the first cabinet;

a second cabinet provided outside the first cabinet; and a storage module provided in a second space defined by the sink, the first cabinet, and the second cabinet, the storage module defining a storage space, and a printed circuit board that controls an operation of the electrically operated device being positioned in the storage space, wherein the first cabinet further includes an upper opening through which the storage module is inserted.

* * * * *